US005267906A

United States Patent [19]

Kitchen et al.

[11] Patent Number: 5,267,906

[45] Date of Patent: Dec. 7, 1993

[54] AMUSEMENT RIDE

[75] Inventors: William J. Kitchen, Boulder, Colo.; Kenneth G. Bird, Casper, Wyo.

[73] Assignee: Sky Fun 1, Inc., Boulder, Colo.

[21] Appl. No.: 937,060

[22] Filed: Aug. 19, 1992

[51] Int. Cl.[5] ..... A63G 9/00

[52] U.S. Cl. ..... 472/118; 472/131; 472/133

[58] Field of Search ..... 472/118, 131, 133, 49, 472/116, 137, 80

[56] References Cited

U.S. PATENT DOCUMENTS

| | | | |
|---|---|---|---|
| 1,229,519 | 6/1917 | Rach | 472/80 |
| 2,311,171 | 2/1943 | Hawthorne | 472/49 |
| 2,779,596 | 1/1957 | Ridgway | 472/116 X |
| 3,476,385 | 11/1969 | Foy | 472/80 |
| 3,701,528 | 10/1972 | Ryan | 472/131 |
| 3,885,503 | 4/1974 | Barber | 472/137 X |
| 4,978,120 | 12/1990 | Greenwood | 472/118 X |
| 5,094,448 | 3/1992 | Hackett | 472/118 X |
| 5,203,744 | 4/1993 | Checketts | 472/131 |

*Primary Examiner*—Carl D. Friedman
*Assistant Examiner*—Kien Nguyen
*Attorney, Agent, or Firm*—Donald W. Margolis; Edwin H. Crabtree

[57] ABSTRACT

The ride is capable of raising a rider to a height of thirty feet or more above the ground, and then releasing the rider to swing. It includes a support structure, a support line secured to the support structure at one end, with an opposed end secured to a rider, preferably to an attachment which is worn by a rider. A launch structure is spaced from the support structure and carries a launch line which has an end which is capable of being raised and lowered above the ground, and which is designed to be releasibly attached to the rider attachment to lift a rider from the ground. A release device is located between the launch line and the rider attachment. In operation, the rider attachment with the support line attached is secured to the rider, the launch line is releasibly secured to the attachment, and the launch line is activated to move the rider laterally and upwardly towards the top of the launch structure. When the launch line is released from the attachment which carries the rider, the rider swings downwardly at a high speed simulating the sensation of "body flight" in a pendulum like motion until slowing to a speed at which he or she may remove the attachment. In an alternative mode of operation, the rider may be lifted up the launch structure, and the support line secured to the rider, with the rider then swinging off of the launch structure.

16 Claims, 2 Drawing Sheets

AMUSEMENT RIDE

BACKGROUND OF THE INVENTION (a) Field of the Invention

This invention relates to a swing type amusement ride which includes a support structure, a launch structure, and a mechanism capable of raising a rider to a position at least thirty feet above the ground, from which position the rider can swing away from the launch structure in a curved trajectory under the support structure.

(b) Description of the Prior Art

Heretofore, there have been a variety of different types of amusement rides and apparatus for simulating the reduction of gravity to a rider. Some of these devices are known to be disclosed in Fitch U.S. Pat. No. 857,338; Ridgway U.S. Pat. No. 2,779,596; Ryan U.S. Pat. No. 3,701,528; and Greenwood U.S. Pat. No. 4,978,120.

Furthermore, there have been a variety of playground and backyard swings and swing sets used by children and adults. These swings can vary in height from a small swing standing 8 to 10 feet high, to a large swing standing twelve to fifteen feet high. A rider of such a swing normally takes a sitting position in a swing seat and starts its pendulum motion from a position in which the swing is vertical, unless aided by a running start, or by a person to help push and enhance the height of the swing arc. While the sitting or standing position on a swing seat is the norm, riders have been known to lie on their stomachs on top of a swing seat and swing in a prone position, but without being secured to the swing.

Even the most skillful and powerful swing rider on a large swing will rarely exceed a 2 o'clock or 10 o'clock position at a height of about twenty feet, before gravity overtakes the centripetal force of the swing, and slack occurs in the swing rope or chain. Should a rider manage to force the swing to make a 360 degree circuit, his or her height would seldom exceed about thirty feet from the ground.

The use external equipment to assist a swing rider to begin his or her ride from an elevated position is taught in Hoppes U.S. Pat. No. 1,731,532; Pruessner U.S. Pat. No. 1,918,559; and Walker U.S. Pat. No. 3,140,870. Each of these references disclose standard playground and backyard type swing systems which have adjacent stairs which a person may climb to start swinging from a position above the ground, and thereby obtain an immediate swing elevation and experience an initial speed which is higher and faster than starting to swing from the ground. But, even in these systems the initial height above the ground which the rider experiences would seldom be more than about four feet to about twelve feet.

In some swing systems, and especially those designed for small children, and in some amusement rides, bungee jumping equipment, parachute equipment, hang gliding systems, and the like, mechanisms for securing a rider to the equipment is provided. But, none of these systems provide a swing ride which initiates a swing release at a height of more than thirty feet above the ground. The prior art swing sets have not been large enough, strong enough or high enough to justify the use of a body harness for holding an adult rider, and especially not for holding and securing such a rider in a prone position, such as in a hang glider. Furthermore, prior art swing technology has not been known to operate at heights which allow a rider to reach a height which is greater than about twenty to thirty feet above the ground, or, other than in a trapeze system, to swing from a "launch" structure towards a "support" structure. It is noted that in trapeze systems, the swings are intentionally "high above the center ring," and never approach the ground.

It is thus seen that nowhere in the prior art is there a swing type amusement ride which includes, in combination, a support structure having an upper portion which is located thirty feet (and as much as several hundred feet or more) above the surface of the ground, a support line having an upper end connected to the upper portion of the support structure and a lower end to which is connected a system for securing a rider to the support line; as well as a launch structure which has an upper portion which is located thirty feet (and as much as several hundred feet or more) or more above the surface of the ground, is spaced from the upper portion of the support structure, and which carries a launch line which includes a launching mechanism for releasable attachment to the rider securing mechanism; and a mechanism associated with the launch structure, but which is not powered by the rider, for raising a rider who has been secured to the system to a height of at least thirty feet (and as much as several hundred feet or more) above the ground, from which height the rider may begin his or her swing away from the launch structure towards the ground in a curved trajectory to simulate the feeling of "body flight".

SUMMARY OF THE INVENTION

It is therefore an object of the present invention to provide a rider of the subject amusement ride with a sensation of "body flight", and an overall feeling similar to that of swooping along the ground in a hang glider, or of skydiving.

Another object of the present invention is to provide the thrills and excitement of bungee jumping, but without the dangers related to the use of rubber or elastic cords, without the possibility of failing to make harness connections to the cord or support line, and without subjecting the body of the rider to the type of stress borne by a bungee jumper, and without the natural fear of a "free fall" plunge associated with bungee jumping.

Yet another object of the present invention is to provide an amusement ride which can be enjoyed by a single rider secured in a single harness, or by a plurality of riders who may enjoy the thrill of riding together while secured in tandem harnesses.

Yet a further object of the present invention to furnish an amusement ride which provides smooth, fast acceleration, excitement and thrills, while being a fail safe ride, without the anxiety and trauma related to finding the nerve to jump from an elevated platform in a "free fall" plunge, such as that which is associated with bungee jumping and sky diving.

Another object of the present invention is to provide a high altitude amusement ride which has a low injury potential for its operators by allowing the operators of the ride to remain on the ground, as opposed to having to work aloft at high altitudes and at risk, as with bungee jumping and sky diving operations.

Another object of the present invention is to provide a swing type amusement ride in which the rider swings back and forth in a pendulum like motion about twenty times or more before terminating the ride.

The present invention provides a swing type amusement ride for raising one or more rider from a position at or near a support surface aloft to a height of thirty feet or more, and then releasing the rider to swing in a curved trajectory for thrill and excitement, but with little or no stress placed on the body of the rider. The amusement ride includes a support structure extending upwardly at least thirty five feet above the ground (and as much as several hundred feet or more). The support structure may be a static tower, a static derrick, a static arch, a bridge, other static man-made structures, a crane, naturally occurring geological formations, and the like. One end of a rider support line is secured to the upper portion of the support structure at a point which is at least thirty five feet from the ground, while the second end of the rider support line is secured to a rider securing attachment, to which a rider can be secured during the ride, and then removed, such as a harness. In preferred embodiments, one end of a second line, which is used as a stabilization line, is also secured to the upper portion of the support structure, while the second end of the stabilization line is also secured to the harness or other attachment which secures the rider during the ride.

Disposed near the support structure is an upright launch structure having an upper portion which is spaced from the upper portion of the support structure. The launch structure may also be a static tower, a static derrick, a static arch, a bridge, other static man-made structures, a crane, naturally occurring geological formations, man made geological formations, and the like, which have an upper portion which has a height which reaches or exceeds at least thirty five feet from the ground (and as much as several hundred feet or more). The upper portion of the launch structure carries a launch line which has a free end which is capable of being lowered and of being raised to a height which reaches or exceeds at least thirty feet above the ground. One end of the launch line is designed to be realeasably attached to the harness attachment which is realeasably secured to the rider. As detailed below, the launch line is capable of raising a rider who is realeasibly secured to a harness or other attachment to a height at least thirty above the ground. The launch line is attached to the release device, preferably a quick release device. The release device, is mounted between the attachment device which carries the rider, and the launch line, preferably in a manner and in a position which allow the rider to release the launch line and begin the swing descent at will.

In operation, in preferred embodiments, the rider is initially in an upright standing position on the ground, or on a stand closely adjacent to the ground, beneath the support structure. The attachment, for example in the form of a body harness, may be secured to the rider by the ride operators at this location or prior to the ride reaching this location. The ride ground crew then attach the support and stabilization lines which are connected to and which depend from the support structure to the body harness attachment of the rider. The ground crew next attaches the launch line which depends from the launch structure to the release device mounted on the body attachment of the rider.

The ride operators then activate the launch line to retract it towards the launch structure at a controlled speed. This causes the rider to be moved laterally from beneath the support structure and towards the launch structure. If the rider is properly connected to the support and/or stabilization lines, then at this time the rider will be raised aloft from the ground, and be suspended from the support structure by the support and/or stabilization lines, and from the launch structure by the launch line. It is to be noted that, as a fail safe measure, if the rider is not properly connected to the support and/or stabilization lines then at this time the rider will be pulled laterally, but will not be immediately raised aloft from the ground, and the operation can be terminated. After the stand on which the rider initially stands is removed, or after the rider is raised aloft by the launch line, he or she is preferably rotated to a prone, face down position by the harness attachment, as detailed below. As the launch line continues to be retracted towards the launch structure at a controlled speed, the rider is raised in a curved path further and further from the ground, towards the launch structure and away from the support structure. When the rider reaches a predetermined height, preferably thirty feet or more above the ground, or when the rider activates the release, the launch line is disconnected from the rider, and the rider begins to fall in a curved trajectory which simulates the sensation of being in "body flight". The resulting sensation, including acceleration to speeds of from about forty five to more than fifty mph, is similar to hang-gliding and skydiving, including the surge of the wind and the excitement of "ground rush" while approaching and passing close over the ground and objects projecting from the ground at high speeds. The rider then continues to swing back and forth in a curved trajectory underneath the support structure until he or she slows to a speed at which the ride operators may stop and remove him or her from the harness attachment.

In preferred embodiments, the support line is made of a aircraft quality stainless steel cable with safety in mind, and the ride does not depend on the use of rubber and elastic bungee cords. As used herein, the "ground" may be an actual ground surface, or a man made surface such pavement, tarmac, a concrete pad and the like. The height of the structures or of the rider from the ground may be measured with respect to the actual "ground", or to a depression below the structures, such as a river bed, ravine, valley, or the like. As used herein, the portion of the support structure to which the support line is attached, and the portion of the launch structure from which the launch line is attached will always be considered to be "upper portion" of the structure.

In an alternative mode of operation, the rider may be lifted directly to the top of the launch structure, the harness or other attachment secured to the rider, and the support line and stabilization line secured to the harness or other attachment. Then, the rider may launch him or herself from the launch structure and experience a ride which is similar to that of the preferred embodiment. In such an operation, the support line and stabilization line will be raised to the top of the launch structure by the launch line. This alternative mode of operation will allow the support and stabilization line to have a substantial amount of slack, thus making the initial part of the ride to be vertical, rather than curved, or, by proper calculation of height an elasticity, the use of bungee support and stabilization lines.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENT

Figure 1:
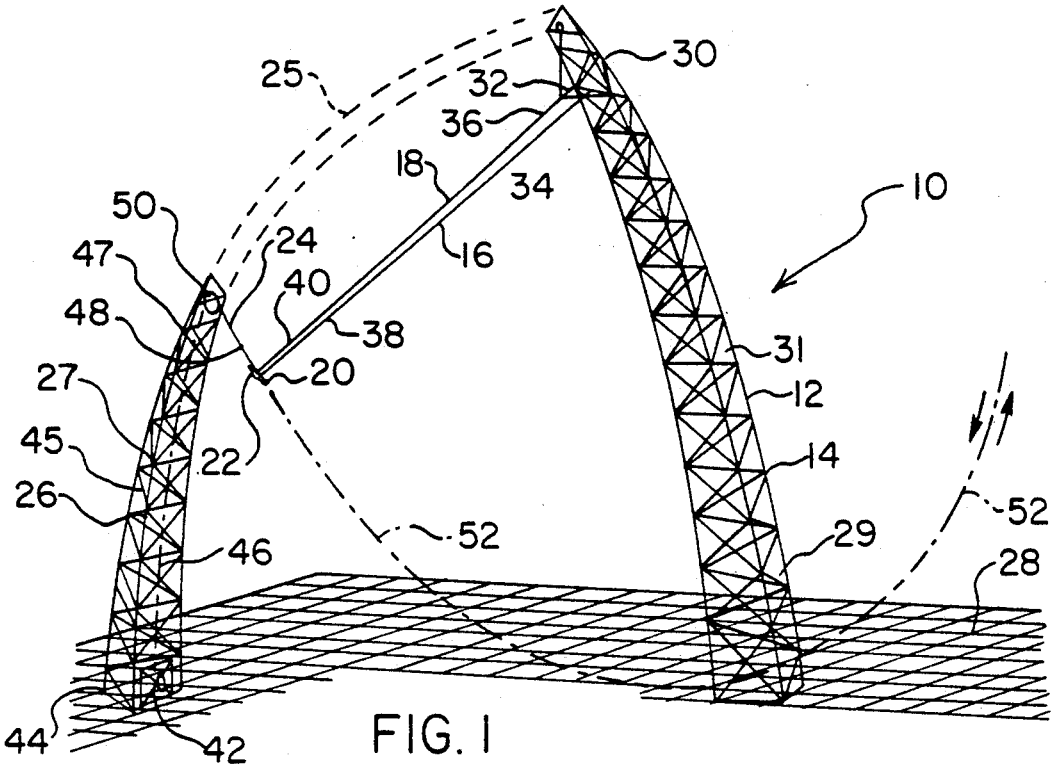
FIG. 1 is a diagrammatic perspective view illustrating the subject invention using a fixed tower, or an arch as a support structure with a single rider suspended from a support line and stabilization line, and connected to a launch line.
Figure 2:
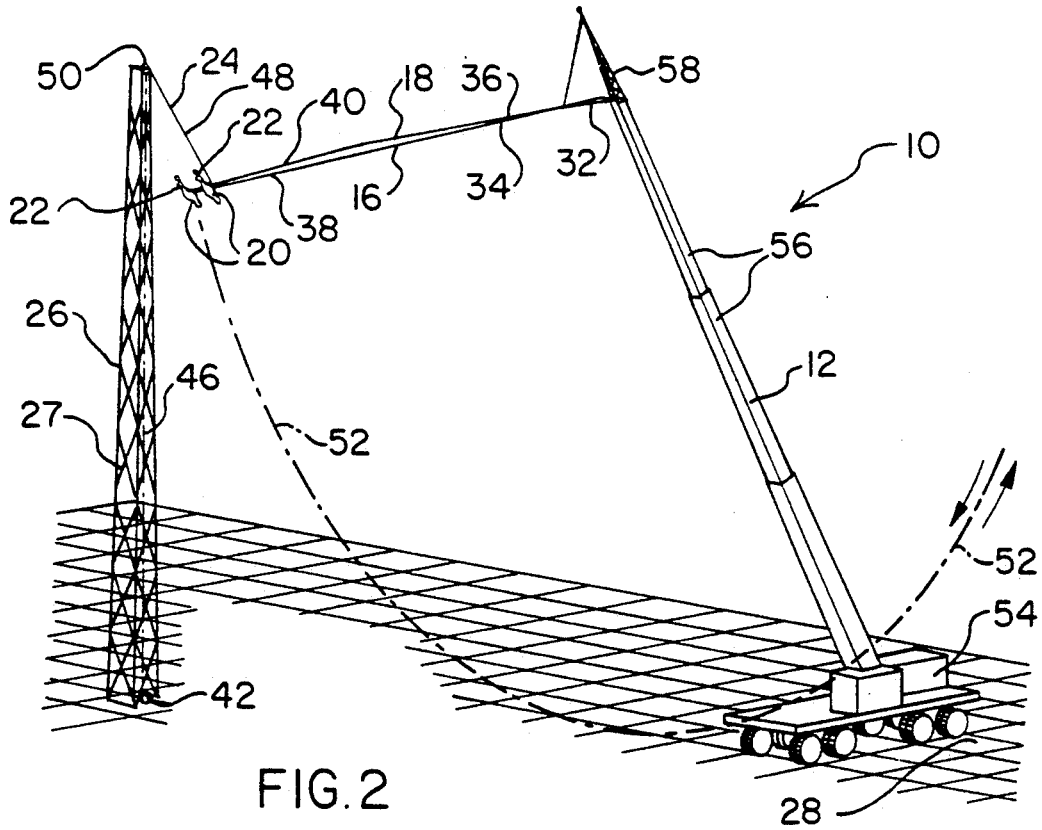
FIG. 2 is a diagrammatic perspective view illustrating the invention using a mobile crane as a support structure with a pair of tandem riders suspended from the support and stabilization lines, and connected to a launch line.

Referring to FIGS. 1 and 2, the subject swing type amusement ride is shown having general reference numeral 10, and with other like elements having like reference numbers in the different figures. In its preferred embodiment, as shown in FIG. 1, swing type amusement ride 10 includes an upright support structure 12, shown in this drawing as a static man made tower 14, a rider support line 16, a rider stabilization line 18, and a body attachment, for example, in the form of a harness 20 (shown in greater detail in FIGS. 6 and 7). Harness 20 is secured to a portion of the body of a rider 22 during the ride, and is removed from the body of a rider 22 after the ride is completed. A launch line 24 depends from launch structure 26, which is also shown as a static tower 27. Launch line 24 may be raised and lowered from launch structure 26, as detailed below. Support structure 12 and launch structure 26 both extend upwardly from the ground 28 to a height of at least thirty five feet, and to as much as several hundred feet, or more. As shown in phantom in FIG. 1, support structure 12 and launch structure 26 may be connected by a crown portion 25, shown in phantom, to form an arch.

The support structure 12 includes a lower portion 29, an upper portion 30 and a middle portion 31. As noted above, the portion of support structure 12 to which the support line is attached will always be considered to be "upper portion" 30. In preferred embodiments, as detailed in FIGS. 3 and 4, a triangle shaped support and stabilization line mechanism 32 is mounted on upper portion 30 of support structure 12. An upper first end 34 of support line 16 and an upper first end 36 of stabilization line 18 are connected to support and stabilization line mechanism 32. In preferred embodiments, support line 16 and upper end 36 of stabilization line 18 are pivotally connected to support and stabilization line mechanism 32. A lower second end 38 of support line 16 and a lower second end 40 of stabilization line 18 include clasps 102 and 103 which can be used to secure support line 16 and stabilization line 18, respectively, to harness 20. As detailed below, after the ride is completed, the same clasps 102 and 103 are used to release support line 16 and stabilization line 18 from harness 20.

Support line 16 may be cable, rope, heavy cord, a rigid pole and the like. Stabilization line 18 and launch line 24 are preferably flexible, and may also be cable, rope, heavy cord, and the like. At this time 5/16 inch diameter aircraft quality stainless steel cables are preferred for all of the lines. Such stainless steel cables are each rated to support nine thousand pounds of weight. In the interest of safety and redundancy, the stabilization line 18 acts as a backup safety line in the unlikely event that support line 16 should break, and vice versa. Furthermore, and as its primary reason for being used, stabilization line 18 acts to insure that support line 16 moves in a curve directly below the horizontally disposed support and stabilization line mechanism 32, which extends directly outward from the upper portion 30 of support structure 12. Also, stabilization line 18 provides an anti-torque means for preventing the rider 22 in harness 20 from twisting during the ride.

Launch structure 26 includes a winch 42 mounted at a lower portion 44 of launch structure 26. The operation of winch 42 will normally be controlled by a ground crew, and may be manually operated, but is preferably motor driven. Launch structure 26 also includes a middle portion 45 and an upper portion 47. Launch line 24 has a first end 46 and a second end 48 which can be releasably attached to body harness 20. Launch line 24 passes over pulley 50 which is rotatably mounted on the upper portion 47 of launch structure 26. The first end 46 of launch line 24 is attached to winch 42 When winch 42 is activated it serves to raise or to lower the second end 48 of launch line 24.

In the embodiments shown in FIGS. 1 and 2, when winch 42 is activated in what would be the counter-clockwise direction in these views, and the second end 48 of launch line 24 and clasps 102 and 103 are attached to harness 20, then rider 22 is raised from a position on or near support surface 28. As noted above, as a fail safe measure, if the rider 22 is not properly connected to the support and/or stabilization lines 16 and 18 by clasps 102 and 103, then at this time the rider 22 will be pulled laterally, but will not be immediately raised aloft from the ground 28, and the operation of the ride can be terminated. As the action of winch 42 continues in the counter-clockwise direction, a properly connected rider 22 will be raised to a high elevated position. As shown in FIGS. 1 and 2, riders 22 are represented as being approximately one hundred and fifty, and two hundred feet, respectively above the ground.

Figure 7:
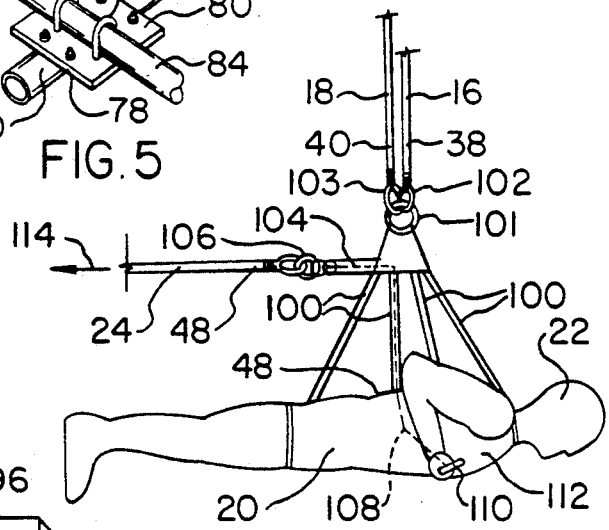
FIG. 7 is a side view of the rider in a prone position in the body harness and suspended from the support and stabilization lines and positioned for being moved aloft by a launch line.

In preferred embodiments, rider 22 can, at will, activate a quick release mechanism 106, as shown in FIG. 7, and detailed below. Release mechanism 106 is located between and is connected to both end 48 of launch line 24 and harness 20. In preferred embodiments, and as detailed below, release mechanism 106 is integral with harness 20, and the second end 48 of launch line 24 is connected to it, and is designed to be activated by rider 22. When the rider activates release mechanism 106, the second end 48 of launch line 24 is released from harness 20. This then allows rider 22 to fall and accelerate downwardly in a curved trajectory moving at speeds greater then fifty miles an hour at the perigee, swooping past ground surface 28, underneath and then past the upper portion 30 of support structure 12. The curve of the rider's swinging motion is shown in FIGS. 1 and 2 as dotted line 52. The rider 22 will continue to swing back and forth along curve 52 in a pendulum motion as many as twenty times, or more, until the swinging motion substantially subsides. The rider 22 can then be manually stopped and released from clasps 102 and 103, and removed from harness 20 by the ground crew.

In FIG. 2, the upright support structure 12 is shown as a mobile crane 54 having a telescoping boom 56 with an upper portion 58 which may be as much as two hundred and fifty feet above the ground, or higher. As in FIG. 1, the upper portion 58 of crane 54 carries a support and stabilization line mechanism 32. In FIG. 2, a pair of riders 22 are shown in a tandem harnesses 20 just prior to release from launch line 24.

Figure 3:
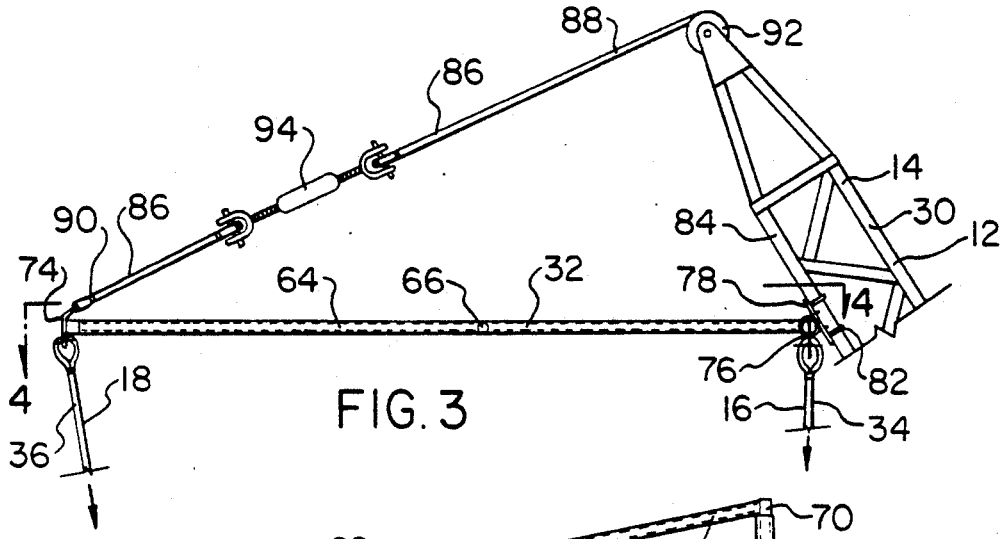
FIG. 3 is an enlarged side view of a support and stabilization line mechanism which is pivotally attached to an upper portion of the support structure.
Figure 4:
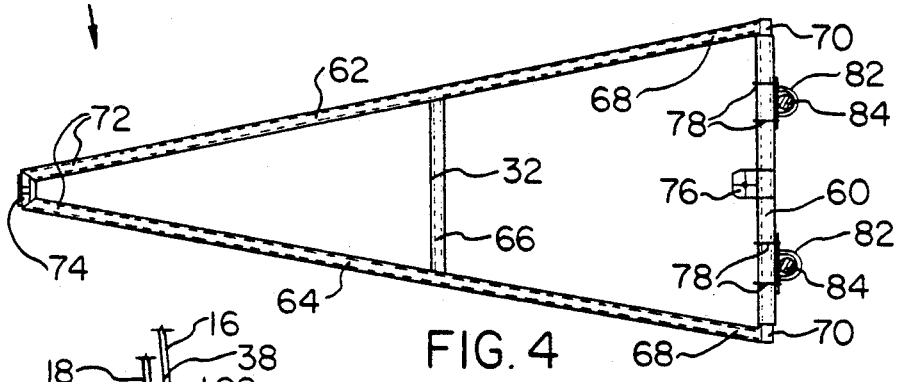
FIG. 4 is a top view of the support and stabilization line mechanism taken along lines 4—4 shown if FIG. 3.

In FIGS. 3 and 4, an enlarged side view and top view, respectively, of the support and stabilization line mechanism 32 is shown. Support and stabilization line mechanism 32 is pivotally attached to upper portion 30 of support structure 12, such as tower 14. The upper portion 30 of tower 14 is the same or similar to the upper portion 58 used with the mobile crane 54. Referring now to both FIG. 3 and FIG. 4, mechanism 32 includes a fixed horizontal cross bar 60 and a pair of lift arms 62 and 64 which together form an internal triangular configuration. Ends 68 of lift arms 62 and 64 are secured together by cross brace 66 to form a still larger triangular configuration. An internal shaft 70 is rotatably located within cross bar 60, and the ends 68 of the lift arms 62 and 64 are attached to the opposed ends of internal shaft 70. Ends 72 of lift arms 62 and 64 come together to form the apex of the triangles, and a stabilization line mounting plate 74 is secured to this apex.

Figure 5:
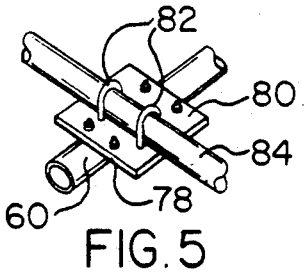
FIG. 5 is an enlarged perspective view of a mounting bracket used to secure the support and stabilization line mechanism to a portion of a metal frame of the support structure.

Cross bar 60 has a support line mounting plate 76 secured thereto and centered along the length of the cross bar 60. Cross bar 60 is secured to the upper portion 30 of the support structure 12 using, for example, a pair of "U" bolts 78 secured to a mounting bracket 80, as shown in an enlarged perspective view in FIG. 5. A second pair of "U" bolts 82 is used to secure a portion of a metal frame 84 of the support structure 12 to the mounting bracket 80. In FIG. 3, the upper first end 34 of support line 16 can be seen attached to and suspended from the support line mounting plate 76. Likewise, in FIG. 3 the upper first end 36 of stabilization line 18 can be seen attached to and suspended from stabilization line mounting plate 74.

It has been found that for smooth swinging and for fast acceleration of rider 22 after he is released from launch line 24 that support line 16 should be maintained taut during the swing so that it will normally carry the full weight of the rider 22. The stabilization line 18 is preferably connected to harness 20 with a slight amount of slack so that it does not cause deflection or deviation of rider 22 as support line 16 moves in a curved trajectory swinging the rider 22 back and forth under the support structure 12. The slack in a fixed length of stabilization line 18 can be adjusted by raising and lowering support and stabilization line mechanism 32, for example by using adjustment line 86. Adjustment line 86 has a first end 88 and a second end 90. The first end 88 of adjustment line 86 is attached to a pulley 92 which is shown mounted on top of the support structure 12. The second end 90 of adjustment line 86 is attached to the stabilization line mounting plate 74. Disposed along the length of the adjustment line 86 is a line tension adjustment mechanism, such as turnbuckle 94. By adjusting the turnbuckle 94 on the adjustment line 86, stabilization line mounting plate 74 at the apex of support and stabilization line mechanism 32 which is pivotally mounted on support structure 12 is raised or lowered. This causes stabilization line 18 to berraised or lowered without the necessity of physically altering the length of line 18, and without raising or lowering support line 16. As mentioned above, stabilization line 18 also acts as a back up safety line and prevents torque or yaw of rider 22 from occurring during flight.

Figure 6:
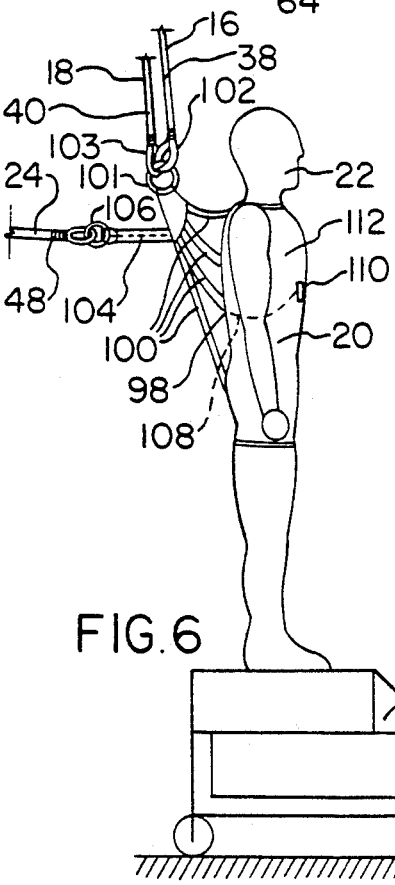
FIG. 6 is a side view showing a rider of the subject amusement ride standing on a moveable stand with a body harness received around a portion of his body.

In FIG. 6, a side view of male rider 22 is shown with the body harness 20 received and secured on his upper body. In this preferred embodiment, rider 22 is shown standing on top of a movable launch stand 96 which is shown resting on the ground 28, and underneath support structure 12. At this location, the lower second ends 38 and 40 of lines 16 and 18, respectively, are suspended vertically downward, and are shown removably connected to support ring 101 of harness 20 by clasps 102 and 103. After the rider 22 is hoisted aloft using the launch line 24, as shown in FIGS. 1, 2 and 7, the launch stand 96 is removed from what will become the path of curve 52, and rider 22 rotates into a face down prone position due to the configuration of harness connection 20. Stand 96 is later returned to a position below rider 22 after the ride is completed in order to help the ground crew and the rider 22 remove the harness 20.

Harness 20 includes a back portion 98 having a plurality of support straps 100 which are joined together around support ring 101. The lower second ends 38 and 40 of support line 16 and stabilization line 18 are attached to support ring 101 from which the rider 22 will be suspended during the ride. The back portion 98 also includes a launch strap 104 to which a release 106, such as the 3-ring parachute type which is illustrated, is attached. Such 3-ring canopy release devices were first, designed in 1976, and are a standard quick release mechanism used in the parachute industry, and is popular in the sport parachute business because it provides a 200:1 mechanical advantage. While the 3-ring release 106 is shown, it is clear that other types of quick releases can be used equally well, such as the older two-button and cable models made for the military by the Capewell Mfg. Co. of Hartford, Conn. Release 106 is connected to a manual launch cord 108 disposed along the side of one of the support straps 100 and terminating at a launch activation handle 110 which is shown to be located on a front portion 112 of the harness 20. During the operation of the present invention, the lower end 48 of launch line 24 is connected to release 106. The rider 22, while moving upward, or when held aloft, can at will use his hand to pull activation handle 110. When activation handle 110 is pulled, this in turn releases quick release 106 from the launch line 24, and allows rider 22 to begin the falling and swinging action of the ride from a height of thirty feet or more from the ground.

After winch 42, shown in FIGS. 1 and 2, has been activated the rider 22 is moved to the left, as indicated by arrow 114, and is then raised aloft using the combination of the pull from launch line 24, and the drag of a properly connected support line 16. The rider 22 in FIG. 7 has moved from a standing position, with lines 16 and 18 substantially vertical, as shown in FIG. 6, to the preferred face down prone position used during the lift and flight of the amusement ride 10. Using support structures 12 and launch structures 26 which are each thirty five feet or more high, rider 22 is moved aloft thirty feet or more above the ground surface 28, depending on the height of the launch structure 26 and support structure 12. The height of the structures notwithstanding, as rider 22 moves upwardly along curved trajectory 52, and as his height above ground surface 28 increases, rider 22 has the option to pull launch activation handle 110 at anytime, and at any height to initiate the swinging falling cycle of the ride. This element of height and release control adds a further dimension of enjoyment to the ride, and encourages most riders to go to the highest possible height above the ground.

While not shown, launch line 24 preferably has a stop that will automatically cause winch 42 to shut down in order to prevent rider 22 from being raised too close to, or into contact with upper portion 47 of launch structure 26. Should the rider 22 be handicapped or otherwise unable to use his hands, the launch activation handle 110 can be controlled from the ground by one of the operators of the amusement ride 10 by a long line, not shown, to activate the release of the rider 22 when desired.

While the subject invention has been shown in the drawings and described above using a launch line 24 associated with a launch structure 26 to raise a rider 22, an additional embodiment of the amusement ride 10, is the use of the same structures as in FIGS. 1 and 2, wherein rider 22 is raised to an elevated position on launch structure 26. For example, the launch structure 26 may include an elevator platform, not shown, wherein the rider 22 is dressed in the body harness 20 and assumes a starting position standing on an elevated portion of launch structure 26. In this modification, the harness 20 of already elevated rider 22 is attached to the support and stabilization lines 16 and 18, substantially in the same manner as shown in FIG. 6. In this method of use, harness 20 would not require launch cord 108 or activation handle 110, since a launch line 24 and release is not used to initiate the swing.

In this alternative example, when rider 22 initiates his swing from an elevated position on launch structure 26 he will descend in a prone position and in the curved trajectory, as shown in dotted lines 52, and swings in a pendulum motion, as in the previous examples. In such an operation, the support line 16 and stabilization line 18 will be raised to the top of the launch structure for connection to harness 20 by launch line 24. This alternative mode of operation allows the support and stabilization line to have a substantial amount of slack, thus making the initial part of the ride substantially vertical. Also, by proper calculation of height and elasticity, bungee type support and stabilization lines may be used to add a bounce to the ride.

It is thus seen that, unlike the prior art, the present invention provides a swing type amusement ride which includes, in combination, a support structure having an upper portion which is located thirty five feet (and as much as several hundred feet or more) above the surface of the ground, a support line having an upper end connected to the upper portion of the support structure and a lower end to which is connected a system for securing a rider to the support line; as well as a launch structure which has an upper portion which is located thirty five feet (and as much as several hundred feet or more) or more above the surface of the ground, is spaced from the upper portion of the support structure, and which carries a launch line which includes a launching mechanism for releasable attachment to the rider securing mechanism; and a mechanism associated with the launch structure, but which is not powered by the rider, which is capable of raising a rider who has been properly secured to the system to a height of at least thirty feet (and as much as several hundred feet or more) above the ground, from which height the rider may begin his or her swing away from the launch structure towards the ground in a curved trajectory to simulate the feeling of "body flight".

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. An amusement ride for raising at least one rider from the ground to a height of at least thirty feet or more and releasing the rider to swing in a curved trajectory, the amusement ride comprising:

an upright support structure having a lower portion, a middle portion and an upper portion, said support structure extending upwardly to a height of at least about thirty five feet or more above the ground;

a rider support line having a first end and a second end, said first end of said support line being attached to said upper portion of said support structure, said support line being normally pivotally suspended vertically downward from said support structure;

means for attaching said second end of said support line to a rider are carried by said second end of said support line;

an upright launch structure having a lower portion, a middle portion and an upper portion, said launch structure extending upwardly to a height of at least about thirty five feet or more above the ground, said upper portion of said launch spaced from said upper portion of said support structure; and means for raising a rider at least thirty feet or more above the ground, said means for raising a rider being associated with said launch structure; whereby, when a rider leaves said raising means the rider will swing freely on said support line.

2. The amusement ride as described in claim 1 wherein said means for raising a rider is a launch line having a first end and a second end, said first end of said launch line being attached to said upper portion of said launch structure, and wherein further, there is provided means for attaching said second end of said launch line to a rider carried by said second end of said launch line.

3. The amusement ride as described in claim 2 wherein means for releasing a rider from said launch line are provided intermediate said means for attaching said second end of said launch line to a rider and said means for attaching said second end of said support line to a rider.

4. The amusement ride as described in claim 3 wherein said means for attaching said second end of said support line to a ride includes a harness received over a portion of a body of a rider.

5. The amusement ride as described in claim 4 wherein said means for releasing is a quick release mechanism carried by said harness.

6. The amusement ride as described in claim 2 further including mechanical means for raising and lowering said launch line on said launch structure.

7. The amusement ride as described in claim 2 further including a stabilization line having a first end and a second end, said first end of said stabilization line being attached to said upper portion of said support structure, said second end of said stabilization line carrying means for attaching said stabilization line to a rider.

8. The amusement ride as described in claim 7 wherein said launch line and said stabilization line are each selected from a group consisting of cable, cord, and rope.

9. The amusement ride as described in claim 7 wherein said harness holds the rider in a prone position when suspended from said second ends of said support and stabilization lines.

10. The amusement ride as described in claim 1 wherein said support structure and said launch structure are each selected from the group consisting of static towers, static derricks, static arches, bridges, other static man-made structures, cranes, and naturally occurring geological formations.

11. The amusement ride as described in claim 1 wherein said support line is selected from the group consisting of cable, rope, cord, and poles.

12. An amusement ride for raising at least one rider from a static position at or near the ground to a height of at least thirty feet or more, and releasing the rider to swing in a curved trajectory, the amusement ride comprising:

an upright support structure having a lower portion, a middle portion and an upper portion, said support structure extending at least thirty five feet or more from the ground;

a rider support line having a given length and a first end and a second end, said first end of said support line attached to said upper portion of said support structure, said second end of said support line attached to a rider, said support line suspended from a normal position on said support structure vertically downward;

an upright launch structure extending upwardly from the ground and disposed from said support structure at a distance not greater than the length of said support line;

a launch line having a first end and a second end, said first end of said launch line attached to means for raising and lowering said launch line on said launch structure;

a harness for receipt over a portion of the rider's body, said second end of said support line attached to said harness, said second end of said launch line also attached to said harness for raising a rider aloft; and release means on said harness and connected to said second end of said launch line for releasing said harness and a rider from said launch line.

13. The amusement ride as described in claim 12 further including a stabilization line having a first and a second end, a support and stabilization line mechanism attached to said upper portion of said support structure and extending outwardly therefrom, said first end of said support line pivotally mounted on one end of said line mechanism, said first end of said stabilization line pivotally mounted on an opposite end of said line mechanism.

14. The amusement ride as described in claim 13 wherein said stabilization line mechanism includes stabilization line tension adjustment means.

15. The amusement ride as described in claim 13 wherein said stabilization line is pivotally mounted on said support structure.

16. An amusement ride for raising at least one rider from a static position at or near a ground aloft at a height of thirty five feet and more and releasing the rider to swing in a curved trajectory, the amusement ride comprising:

an upright support structure having a lower portion, middle portion and upper portion, said support structure extending upwardly from the ground;

a rider support line having a given length and a first end and a second end, said first end of said support line attached to said upper portion of said support structure, said second end of said support line attached to a rider, said support line suspended from a normal position on said support structure vertically downward;

a rider stabilization line having a first end and a second end, said first end of said stabilization line attached to said upper portion of said support structure;

an upright launch structure extending upwardly from said ground and disposed from said support structure at a distance not greater than said length of said support line;

an upright launch structure extending upwardly from said ground and disposed near said support structure;

a launch line having a first end and a second end, said first end of said launch line attached to means for raising and lowering said launch line on said launch structure;

a harness for receipt over a portion of a body of a rider, said second end of said support line attached to said harness and said second end of said stabilization line also attached to said harness, said second end of said launch line also attached to said harness for raising a rider aloft; and release means on said harness and connected to said second end of said launch line for releasing said harness and a rider from said launch line.

* * * * *

UNITED STATES PATENT AND TRADEMARK OFFICE

CERTIFICATE OF CORRECTION

PATENT NO. : 5,267,906

DATED : December 7, 1993

INVENTOR(S) : William J. Kitchen, Kenneth G. Bird

It is certified that error appears in the above-indentified patent and that said Letters Patent is hereby corrected as shown below:

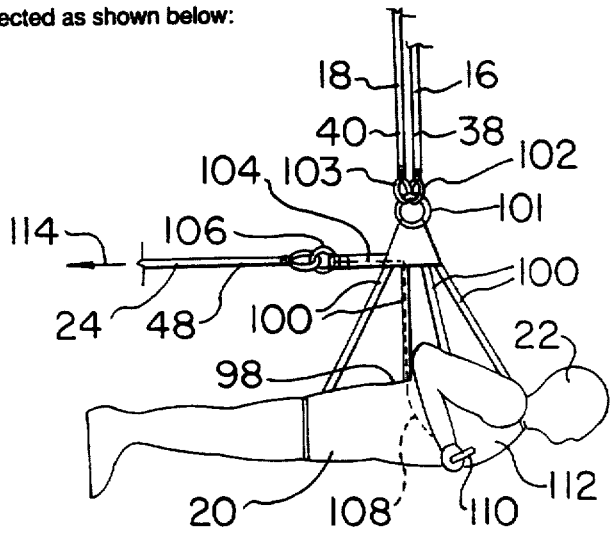

FIG. 7

Number --98-- replaces duplicative number "48" in FIG. 7 as shown.

Signed and Sealed this

Seventeenth Day of December, 1996

Bruce Lehman

*Attest:*

BRUCE LEHMAN

*Attesting Officer*

*Commissioner of Patents and Trademarks*